US006664509B2

(12) United States Patent
Moulin et al.

(10) Patent No.: US 6,664,509 B2
(45) Date of Patent: Dec. 16, 2003

(54) METHOD FOR SECURING SHEET PILES

(75) Inventors: Jean-Michel Moulin, Saint Julien les Metz (FR); André Rix, Messancy (BE)

(73) Assignee: International Sheet Piling Company Sarl, Luxembourg (LU)

( * ) Notice: Subject to any disclaimer, the term of this patent is extended or adjusted under 35 U.S.C. 154(b) by 0 days.

(21) Appl. No.: 10/240,254

(22) PCT Filed: Mar. 19, 2001

(86) PCT No.: PCT/EP01/03131

§ 371 (c)(1),
(2), (4) Date: Sep. 27, 2002

(87) PCT Pub. No.: WO01/73210

PCT Pub. Date: Oct. 4, 2001

(65) Prior Publication Data

US 2003/0034338 A1 Feb. 20, 2003

(30) Foreign Application Priority Data

Mar. 29, 2000 (LU) ..... 90558

(51) Int. Cl.[7] ..... B23K 9/24; E02D 5/22

(52) U.S. Cl. ..... 219/137 R; 219/137.2; 405/274

(58) Field of Search ..... 219/137 R, 121.14, 219/121.53, 137.2; 405/274, 276, 278, 279

(56) References Cited

U.S. PATENT DOCUMENTS

| | | | | | |
|---|---|---|---|---|---|
| 4,981,540 | A | * | 1/1991 | Prochhorst | 156/157 |
| 5,921,716 | A | * | 7/1999 | Wickberg et al. | 405/278 |
| 6,042,306 | A | * | 3/2000 | Arndts et al. | 405/279 |
| 6,092,346 | A | * | 7/2000 | Even et al. | 52/579 |
| 6,282,762 | B1 | * | 9/2001 | Wall | 24/573.09 |
| 6,357,969 | B1 | * | 3/2002 | Wheeler et al. | 405/274 |
| 6,443,664 | B1 | * | 9/2002 | Horan et al. | 405/279 |

FOREIGN PATENT DOCUMENTS

EP 0 898 021 A 2/1999

* cited by examiner

*Primary Examiner*—M. Alexandra Elve
*Assistant Examiner*—Len Tran
(74) *Attorney, Agent, or Firm*—McCormick, Paulding & Huber LLP

(57) ABSTRACT

A method for securing two sheet piles includes interlocking the two sheet piles by utilizing sheet pile interlocks having an axial groove formed between the sheet pile interlocks. The method further includes introducing a welding electrode into the axial groove and welding the interlocked sheet pile interlocks together.

16 Claims, 5 Drawing Sheets

METHOD FOR SECURING SHEET PILES

FIELD OF THE INVENTION

The present invention relates to a method for securing two sheet piles interlocked by means of sheet pile interlocks.

BACKGROUND OF THE INVENTION

The use of sheet piles for constructing retaining walls is well known. The sheet piles used in such walls have sheet pile interlocks along their longitudinal edges, which can be interlocked so as to maintain the longitudinal edges of adjacent sheet piles interconnected with each other. Current sheet pile interlocks of the double-hook interlock type (type 1 according to EN10248 norm), as e.g. LARSSEN type sheet pile interlocks, are hook shaped elements with an internal interlock chamber. A sheet pile wall is formed by driving a first sheet pile into the ground, introducing the bottom end of the trailing sheet pile interlock of a second sheet pile with the top end of the leading sheet pile interlock of the first sheet pile, driving the second sheet pile into the ground, and then repeating the process to insert third, fourth etc sheet piles into the wall.

It is often necessary to secure two interconnected sheet piles against longitudinal shifting relative to one another for example at a harbour, canal, or building-excavation construction site. This is particularly the case for sheet pile walls constructed with U-shaped sheet piles having the sheet pile interlocks aligned along the neutral plane of the sheet pile wall.

It is known to secure two interconnected sheet piles by bonding the interlocked sheet pile interlocks with a curing mass, e.g. an adhesive or cement. However, the shearing strength of an adhesive bond is limited. Furthermore, this bond is often not reliable because of ground material and/or water penetrating the interlock chamber.

According to EP-0 898 021, two interconnected sheet piles can be secured by pressing impressions on the outer connection joint between the two interlocked sheet pile interlocks. The pressing of these impressions are effected by means of a punch adapted to be operated by a hydraulic percussion hammer. The securing of interconnected sheet piles by pressing impressions is e.g. used for combining sheet piles into double or triple sheets, also known as driving units, prior to driving them into the ground. Of course, such an impression can only be made on the sheet pile interlocks which are accessible from at least one side. It follows that driving sheets cannot be secured in this way once they are driven into the ground. After excavation on one side of the sheet pile wall the sheet pile interlocks are again accessible. It is however during excavation that the unsecured sheet pile interlocks tend to shift and the sheet pile wall is deformed. The securing of sheet piles after excavation is hence of little importance. It follows that there is a need for a method for securing sheet piles after they have been driven into the ground, but before excavation takes place. Furthermore, in order to render the interlocked sheet pile interlocks waterproof, a welding seam can be made on the outer connection joint between two interlocked sheet pile interlocks. This welding seam can of course only be made on the interlocks of two adjacent sheet piles which are accessible, i.e. before they are driven into the ground or after excavation. The interlocked sheet pile interlocks between two driving units cannot be rendered waterproof in this way. Even if the welding seam is made after excavation, the welding seam can only be made on the top half, often only the top third of the sheet pile interlocks, as the remaining part of the sheet pile wall is still not accessible. The remaining part of the sheet pile wall can hence not be rendered waterproof.

SUMMARY OF THE INVENTION

The technical problem underlying the present invention is to provide a reliable method for firmly securing sheet pile interlocks against longitudinal shifting relative to one another, even if the sheet pile interlocks are not accessible. This problem is solved by a method as claimed.

GENERAL DESCRIPTION OF THE INVENTION

In accordance with the method of the present invention a welding electrode is axially inserted into an axial groove between the sheet pile interlocks, which are then welded together in the groove. The sheet pile interlocks need not be accessible from the outside in order to make a welding. It follows that sheet piles or driving units can now also be secured after having been driven into the ground. This is of particular advantage in case excavation is to take place as the sheet piles or driving units can be secured beforehand. The sheet pile interlocks can hence not shift and the sheet pile wall cannot deform during the excavation process.

It will be appreciated that a method in accordance with the invention is particularly advantageous if the interlocked sheet pile interlocks are at least partially located below ground level. The welding electrode can then be axially introduced through the axial groove below ground level and the sheet pile interlocks can be welded together below ground level. The method hence allows firmly securing two sheet piles or driving units, after they are driven into the ground. It will be appreciated that the welding operation allows to provide a bond with a higher shearing strength than a bond achieved by injecting a curing mass, and that the welding operation is far less affected by ground material and/or water penetrating the interlock chamber than a curing operation. Furthermore, a continuous welding seam can be made along the whole length of the axial groove, whereby the sheet pile wall can be rendered waterproof along the whole of its height.

The welding electrode is connected to a conductor, which is preferably a semi-rigid conductor, e.g. an electrically insulated copper conductor, so that it can be used to push the welding electrode far down into the axial groove.

According to a first embodiment, the welding electrode is axially introduced into the axial groove up to a first depth, where a first welding is made. The welding electrode is then drawn back to a second depth; where a second welding is made. This discontinuous welding allows for time saving securing operation.

According to a second embodiment, the welding electrode is axially introduced into the axial groove up to a first depth, where the welding electrode is consumed by making a welding. The conductor is then withdrawn from the groove and connected to a new welding electrode, which is then axially introduced into the axial groove up to a second depth, where it is consumed by making another welding. The second depth can for example correspond to the end of the first welding, so that a continuous welding seam is obtained. This continuous welding provides a sealed connection between two sheet piles.

It is advantageous to use a fluxed electrode, as such an electrode facilitates arc ignition and stability during welding. It also allows welding to take place under water and it can be easily used on site with conventional welding generators. The fluxed electrode also has the particular advantage that it allows for a discontinuous welding, i.e. local weldings can be made at different depths in the axial groove.

A straightener can be used for introducing the semi-rigid conductor with the welding electrode into the groove. It straightens the semi-rigid conductor and pushes it down the axial groove. It can further be used to pull the conductor back out of the axial groove.

When constructing a sheet pile wall, the first sheet pile is first driven into the ground. The leading sheet pile interlock of the first sheet pile has an interlock chamber protected from ground material. An interlock head of a trailing sheet pile interlock of a second sheet pile is engaged in the interlock chamber when the second sheet pile is driven into the ground. The interlock head preferably has an axial groove facing a wall of the interlock chamber for receiving the welding electrode.

The interlock chamber can have a substantially right angle corner. The interlock head engaging the interlock chamber preferably has a cross-section that is complementary to the cross-section of the interlock chamber, and the axial groove is located at the thickest part of the interlock head and facing the right angle corner of the interlock chamber. By providing the axial groove at the thickest part of the interlock head, the stability of the sheet pile interlock is maintained, as the sheet pile maintains a minimum thickness over the whole of its section. It will however be appreciated that the axial groove can also be located at any other part of the interlock head. It will also be appreciated that instead of being associated to the trailing sheet pile interlock, the axial groove can alternatively be associated to the leading sheet pile interlock. It is also possible to have two axial grooves between the sheet pile interlocks, one associated to the trailing sheet pile interlock, and the other associated to the leading sheet pile interlock. It is even conceivable to have two smaller axial grooves, one associated to each sheet pile interlock, located such that, when the sheet pile interlocks are interlocked, an axial groove, which is big enough to receive the electrode, is formed.

The interlock chamber can further comprise a sealant arranged at least along part of its walls for sealing, and hence rendering water proof the connection joint between two sheet piles.

In accordance with an embodiment of the present invention an obturating device comprising an inflatable tube is inserted into the interlock chamber of the sheet pile interlock to be protected. Once the obturating device is in place within the interlock chamber, its inflatable tube is inflated, so that the obturating device effectively closes the opening to the interlock chamber. It follows that no ground material can enter the interlock chamber while the sheet pile is being driven into the ground. Once the sheet pile is in place, the inflatable tube is again deflated, and the obturating device can be easily withdrawn from the interlock chamber. In short, while the inflatable tube is inflated, the obturating device ensures excellent protection for the interlock chamber against ground material, and while the inflatable tube is deflated, the obturating device can be easily inserted into or retracted from the interlock chamber.

The obturating device can further comprise a flexible tube with an open front end alongside the inflatable tube which has a closed front end. This flexible tube can then be used for filling the interlock chamber with sand or synthetic foam (as e.g. a PU foam) while the obturating device is withdrawn from the interlock chamber. Especially in case the sheet piles are driven into light or muddy ground material, it is advantageous to fill the interlock chamber with sand or synthetic foam material in order to prevent light or muddy ground material to enter the interlock chamber once the obturating device has been withdrawn. It is not excluded to conceive the flexible tube as a separate piece, but it is preferred to firmly attach it to the inflatable tube and, in particular, to form it in one piece with the inflatable tube.

In accordance with a preferred embodiment, inflation of the inflatable tube pushes an obturating block into the longitudinal opening of the interlock chamber. This obturating block closes the longitudinal opening of the interlock chamber. It will be appreciated that the obturating block can be made stronger than the inflatable tube and is hence less likely to be damaged during the driving process. It is preferably a semi-rigid body, because such a semi-rigid body may be more easily introduced in and withdrawn from the interlock chamber. Furthermore, it is preferably a wedge shaped body engaging the longitudinal opening of the interlock chamber. The wedge shape ensures that, when the inflatable tube is inflated, the obturating block centres itself in the longitudinal opening of the interlock chamber so as to effectively obturate this opening from the inside of the interlock chamber. It is not excluded to conceive the obturating block as a separate piece, but it is preferred to firmly attach it to the inflatable tube and, in particular, to form it in one piece with the inflatable tube. The fact that the inflatable tube and obturating block are firmly attached together allows for easy manipulation on the building site.

In particular, when constructing a sheet pile wall, the obturating device is inserted into the interlock chamber of the leading sheet pile interlock of a first sheet pile. The inflatable tube is inflated, e.g. by means of compressed air, and this first sheet pile is driven into the ground. Once this first sheet pile is in place, the inflatable tube is deflated and the obturating device is withdrawn from the interlock chamber. It will be appreciated that the withdrawn obturating device leaves an interlock chamber in the leading sheet pile interlock that is perfectly clean, i.e. free from any ground material. The obturating device is then inserted into the interlock chamber of the leading sheet pile interlock of a second sheet pile and the inflatable tube is inflated. The bottom end of the trailing sheet pile interlock of the second sheet pile is now interconnected with the top end of the leading sheet pile interlock of the first sheet pile. As the second sheet pile is driven into the ground, its trailing sheet pile interlock slides down through the clean interlock chamber of the leading sheet pile interlock of the first sheet pile. Once the sheet pile is in place, the inflatable tube is again deflated and the obturating device withdrawn. This process is repeated for the third, fourth, etc sheet piles. Consequently, the trailing sheet pile interlock of a sheet pile is always interconnected with a clean leading sheet pile interlock of the preceding sheet pile.

Before driving a sheet pile into the ground, it is recommended to insert a front end obturator in the bottom end of the interlock chamber of a leading sheet pile interlock. The front end obturator displaces ground material from under the axial opening of the interlock chamber and prevents ground material from axially entering the interlock chamber. It will be appreciated that the front end obturator can e.g. be a simple bolt. However, in order to be most effective, the front end obturator advantageously has a conical head. The front end obturator is preferably just inserted into the interlock chamber, rather than fixed to the sheet pile, so that the front end obturator can simply be pushed out of the interlock chamber of the leading sheet pile interlock by the trailing sheet pile interlock of the subsequent sheet pile. This is of particular interest in case a sheet pile needs to be driven deeper into the ground than the preceding one.

A short cleaning piece is preferably engaged with the leading sheet pile interlock of a first sheet pile before interconnecting this interlock with the trailing sheet pile interlock of a second sheet pile. When the second sheet pile is driven into the ground, its trailing sheet pile interlock pushes the cleaning piece along the leading sheet pile interlock of the first sheet pile. It will be appreciated that the cleaning piece can e.g. be a piece of an interlocking sheet pile interlock, which removes any ground material from the inner walls of the leading sheet pile interlock and preferably wraps the outer walls of the leading sheet pile interlock, so that it also effectively removes any ground material from the outer walls of the leading sheet pile interlock. It follows that all exterior and interior contact surfaces of the leading sheet pile interlock are free of ground material when coming into contact with the corresponding contact surfaces of the trailing sheet pile interlock of the subsequent sheet pile. Usage of the cleaning piece is particularly of advantage if the interlock chamber of the leading sheet pile interlock of the first sheet pile has been filled with sand as the obturating device was withdrawn from the interlock chamber.

It will be appreciated that alternative protection means for protecting the interlock chamber from ground material can be considered.

BRIEF DESCRIPTION OF THE DRAWINGS

The present invention will now be described, by way of example, with reference to the accompanying drawings, in which.

DETAILED DESCRIPTION OF A PREFERRED EMBODIMENT

Figure 1:
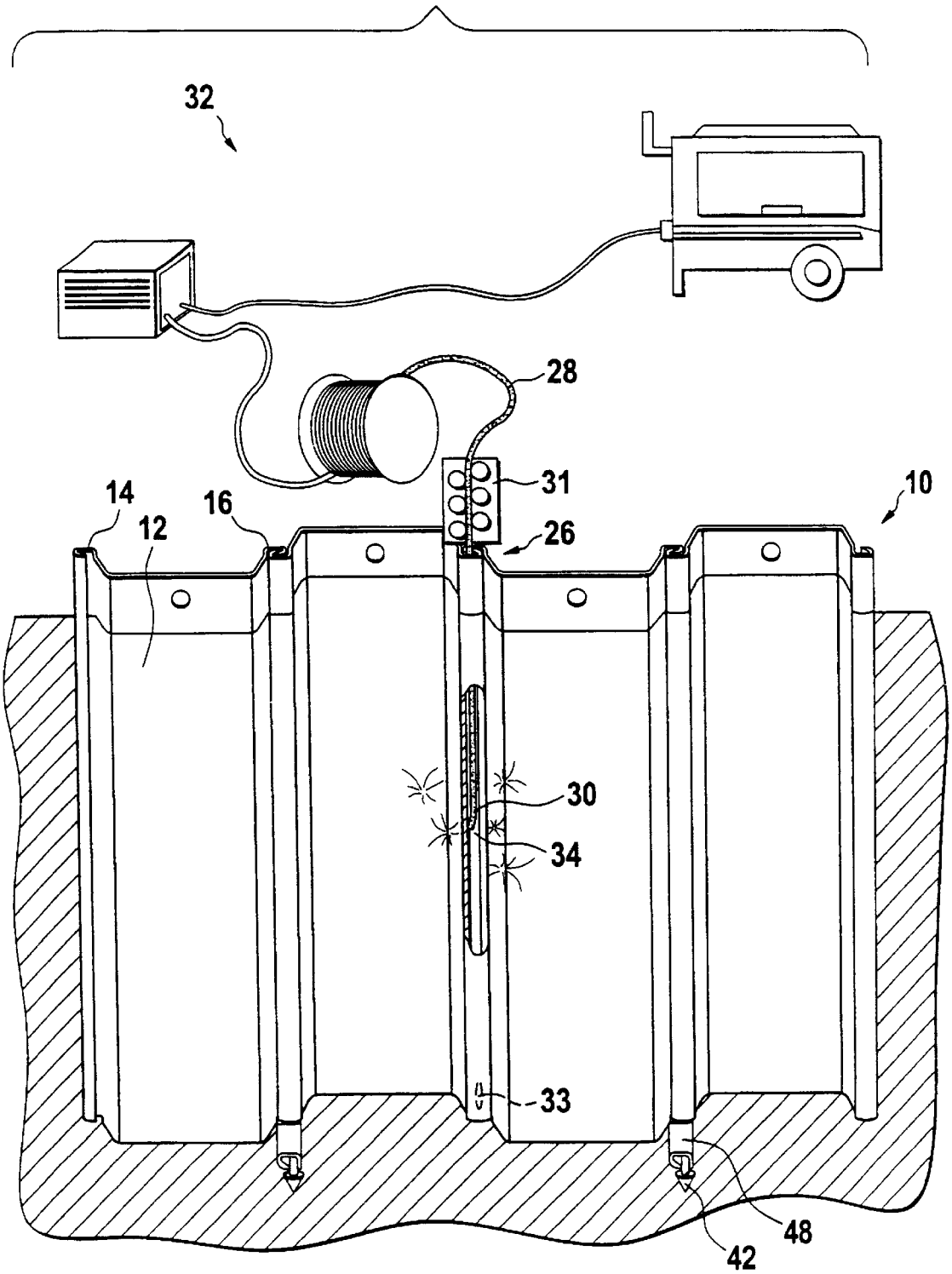
FIG. 1: is a perspective view of a sheet pile wall.

FIG. 1 shows a sheet pile wall 10 in place in the ground. The sheet pile wall 10 is constructed with interlocked sheet piles 12, which each have a trailing 14 and a leading sheet pile interlock 16.

Figure 2:
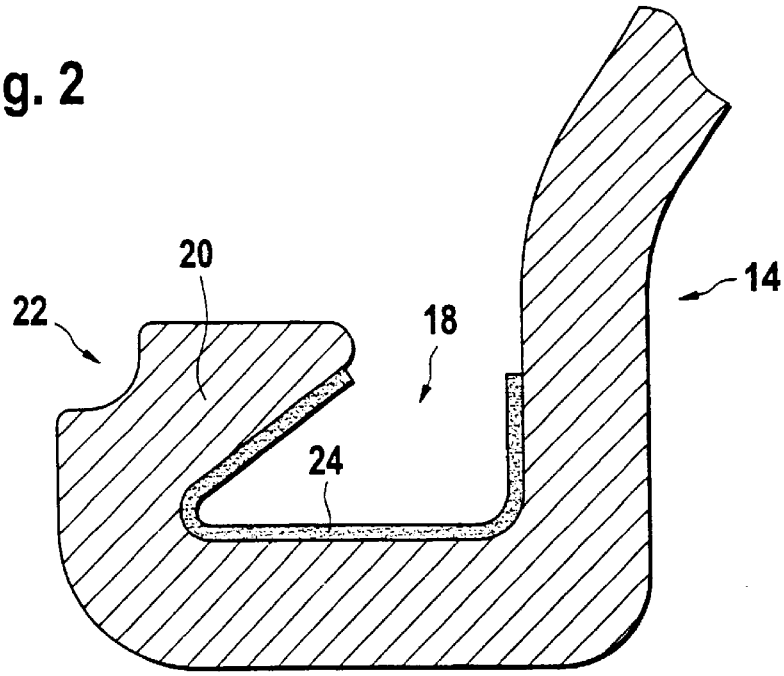
FIG. 2: is a section through a trailing sheet pile interlock.
Figure 3:
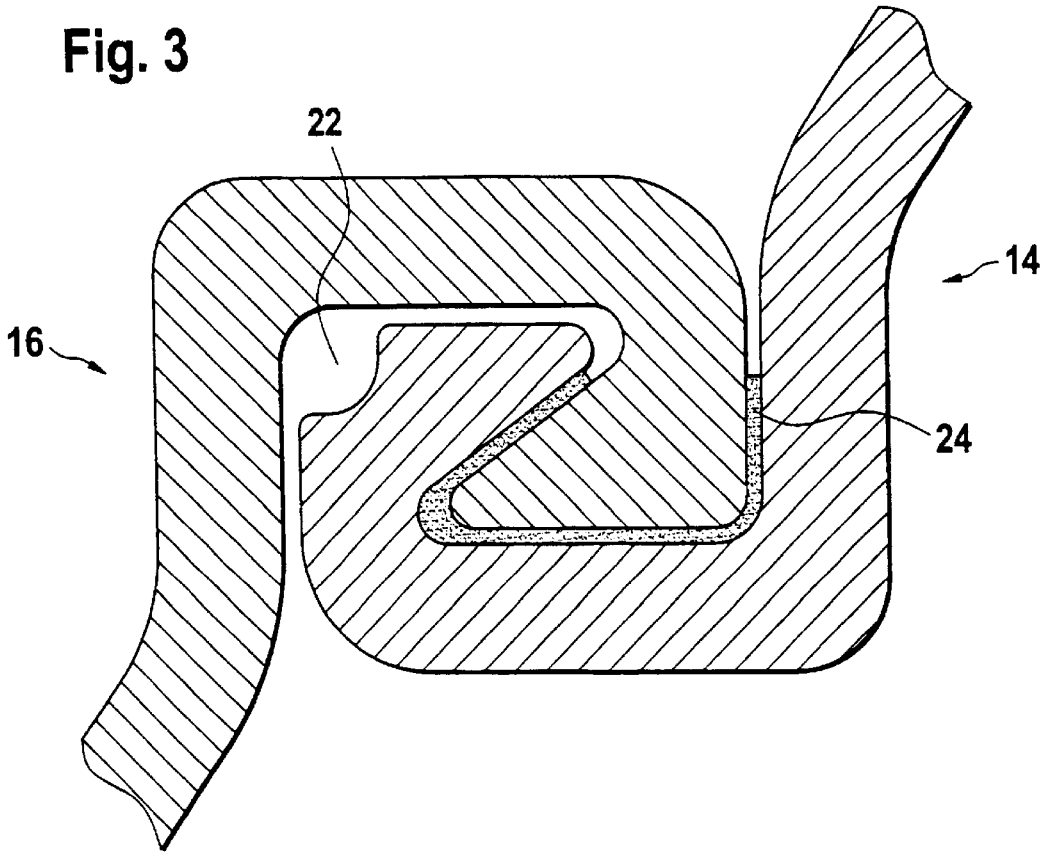
FIG. 3 is a section through a trailing sheet pile interlock interlocked with a leading sheet pile interlock.

FIGS. 2 and 3 show a section through the trailing sheet pile interlock 14 on its own, and interlocked with a leading sheet pile interlock 16 of an adjacent sheet pile respectively. Each hook-shaped sheet pile interlock 14, 16 comprises an interlock chamber 18 and an interlock head 20. The interlock head 20 of one sheet pile engages the interlock chamber 18 of the other sheet pile, the interlock chamber 18 and the interlock head 20 having complementary cross-sections. The thickest corner of the interlock head 20 of the trailing sheet pile interlock 14 comprises an axial groove 22. Furthermore, the interlock chamber 18 of the trailing sheet pile interlock 14 comprises a sealant 24 arranged at least along part of its walls. The axial groove 22 preferably has a diameter between 5 and 15 mm, ideally 8 mm, so as to receive a welding electrode.

Referring back to FIG. 1, reference number 26 designates two interlocked sheet pile interlocks 14, 16. A straightener 31 is used to introduce a semi-rigid copper conductor 28, having a fluxed welding electrode 30 at its end, into the axial groove 22 arranged in the trailing sheet pile interlock 14. Conventional welding apparatus 32 can be used for operating the welding electrode 30. The welding electrode 30 is introduced into the axial groove 22 up to a first depth, where a first welding 33 is made. Once this first welding 33 is made, the welding electrode 30 is drawn back to a second depth, where a second welding 34 is then made. It will be appreciated that third, fourth, etc weldings can be made in the axial groove in the same way. Once an electrode 30 is consumed, the conductor 28 can be withdrawn from the axial groove 22 by means of the straightener 31. A new electrode 30 is attached to the conductor 28, which is then reintroduced into the axial groove 22 for making a further welding. If these weldings are created so close to each other that they touch, a continuous welding seam can be created in the axial groove 22.

Figure 4:
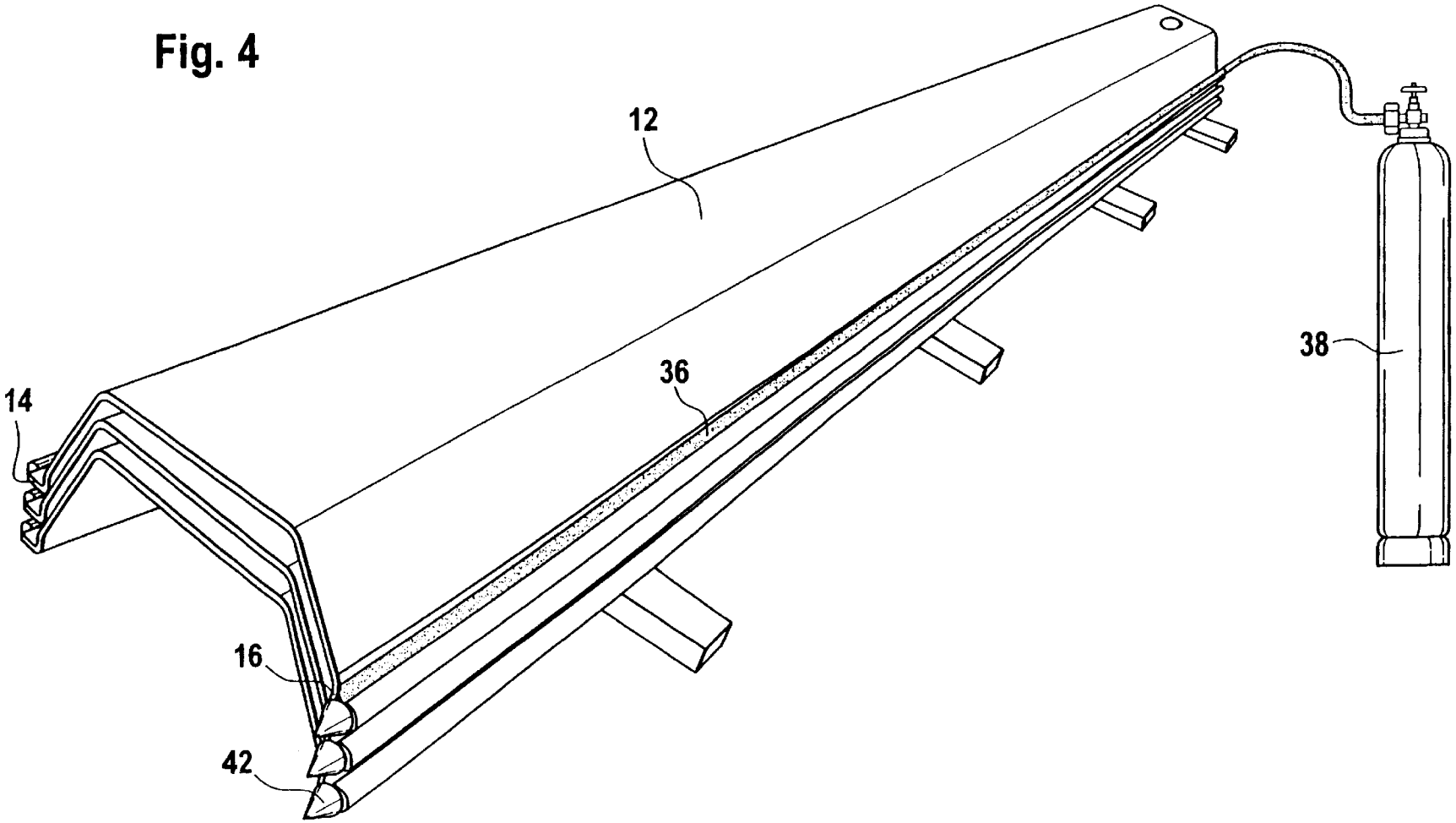
FIG. 4 is a perspective view of three sheet piles horizontally placed on the ground.

FIG. 4 shows some sheet piles 12 horizontally placed on the ground at the work site. An obturating device 36 is inserted in the leading sheet pile interlock 16 and inflated by compressed air means 38.

Figure 5:
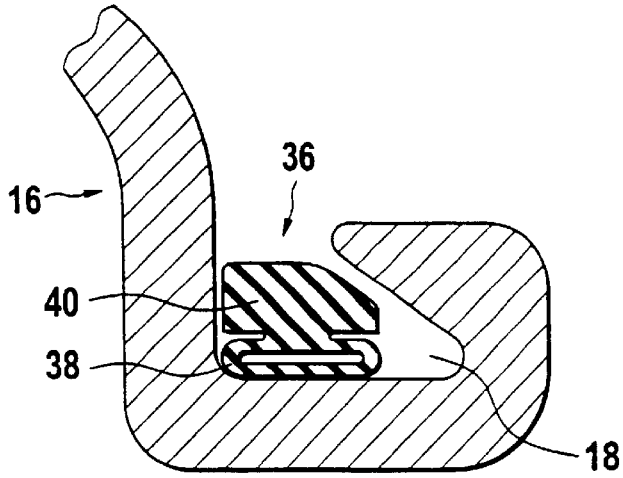
FIG. 5 is a section through a deflated obturating device inside a sheet pile interlock.
Figure 6:
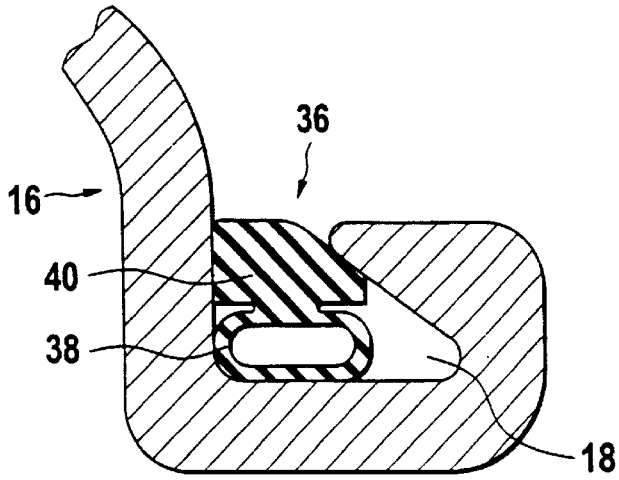
FIG. 6 is a section through an inflated obturating device inside a sheet pile interlock.

The obturating device 36 is described in more detail by referring to FIGS. 5 and 6, in which the obturating device 36 is arranged. The obturating device 36 comprises an inflatable tube 38 and a wedge shaped obturating block 40. FIGS. 5 and 6 show the inflatable tube 38 in its deflated and inflated state respectively. When the inflatable tube 38 is inflated, the obturating block 40 is firmly pressed in the longitudinal opening, which gives access to the interlock chamber 18. In other words, it blocks off this longitudinal opening of the interlock chamber 18, thereby preventing ground material from entering into the interlock chamber 18 through this opening.

Figure 7:
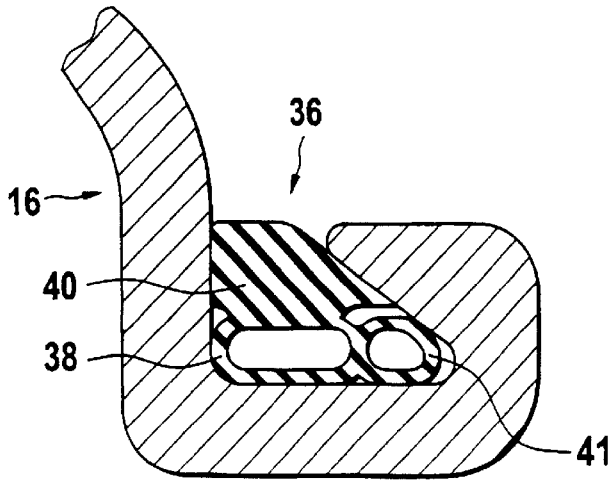
FIG. 7 is a section through an inflated obturating device with flexible tube inside a sheet pile interlock.

FIG. 7 shows an obturating device 36 having a flexible tube 41 running alongside the inflatable tube 38. The flexible tube 41 has an open front end and is used to insert sand into the interlock chamber 18 when the obturating device 36 is being removed from the interlock chamber 18. The longitudinal opening of the interlock chamber 18 is thereby blocked off, whence preventing ground material from entering into the interlock chamber 18 through this opening.

It will be noted that the preferred obturating device 36 shown in FIGS. 5 and 6 and in FIG. 7 is a semi-rigid rubber piece. It may include synthetic or metallic reinforcement fibres or fabrics, which increase its tensile strength. Its surfaces coming into contact with the walls of the sheet pile interlock may receive a friction reducing coating.

Figure 8:
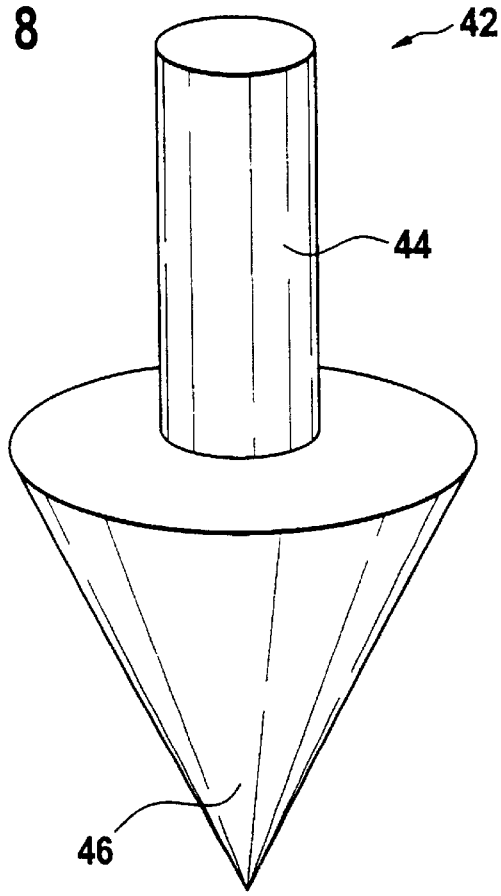
FIG. 8 is a perspective view of a front end obturator.
Figure 9:
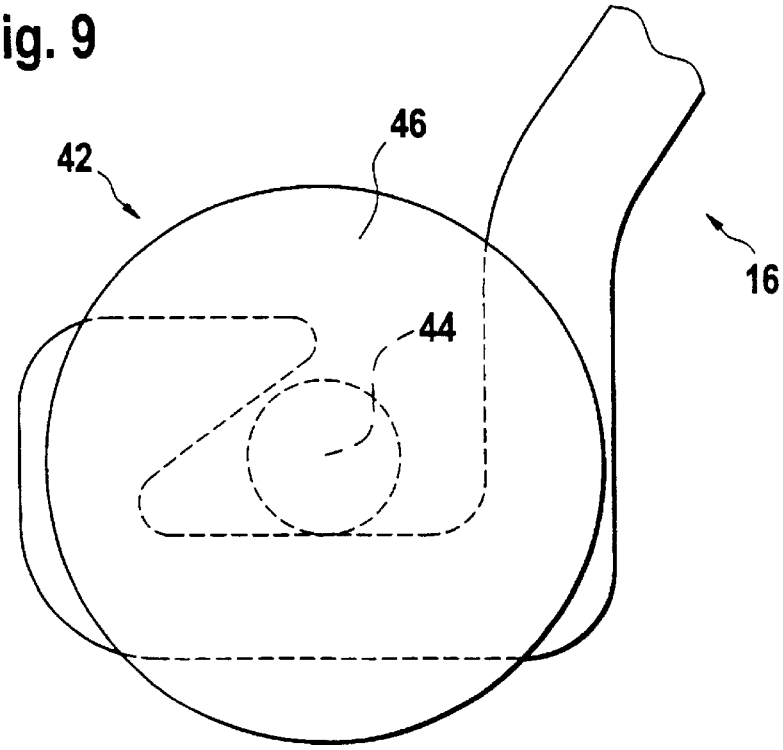
FIG. 9 is a schematic underneath view of the front end obturator of FIG. 8.

In order to protect the interlock chamber 18 from soil being pushed in axially from below as the sheet pile 12 is being driven, a front end obturator 42 is inserted in the bottom end of the interlock chamber 18. This front end obturator 42, which is shown in FIGS. 8 and 9, has a cylindrical body 44 and a conical head 46.

Before the second sheet pile is interlocked with the first sheet pile and driven into the ground, a short cleaning piece 48 is engaged in the leading sheet pile interlock 16 of the first sheet pile for removing any ground material from the inner walls of the leading sheet pile interlock 16. The short cleaning piece 48 shown in FIG. 1 wraps the outer walls of the leading sheet pile interlock 16 and has an acute front end. Consequently, when it is pushed down along the leading sheet pile interlock 16 by the trailing sheet pile interlock 14 of the second sheet pile, it effectively removes any ground material from the outer walls of the leading sheet pile interlock 16.

What is claimed is:

1. A method for securing two sheet piles comprising the steps of:

a) interlocking said two sheet piles by means of sheet pile interlocks, wherein an axial groove is formed between said interlocked sheet pile interlocks;

b) axially introducing a welding electrode into said axial groove between said interlocked sheet pile interlocks; and c) welding said interlocked sheet pile interlocks together in said axial groove.

2. The method according to claim 1, wherein:

after step a), said interlocked sheet pile interlocks are at least partially located below ground level;

during step b), said welding electrode is axially introduced through said axial groove below ground level; and during step c), said sheet pile interlocks are welded together in said axial groove below ground level.

3. The method according to claim 1, wherein said welding electrode is connected to a semi-rigid conductor before carrying out step b).

4. The method according to claim 1, wherein:

during step b), said welding electrode is axially introduced into said axial groove up to a first depth;

during step c), a first welding is made at said first depth, then said welding electrode is drawn back to a second depth, and a second welding is made at said second depth.

5. The method according to claim 1, wherein:

said welding electrode is connected to a semi-rigid conductor before carrying out step b);

during step b) said welding electrode is axially introduced into said axial groove up to a first depth;

during step c) said welding electrode is consumed by making a first continuous welding starting at said first depth and drawing said welding electrode back;

once said welding electrode is consumed, said conductor is withdrawn from said axial groove and connected to a new welding electrode;

said new welding electrode is axially introduced into said axial groove up to a second depth above said first continuous welding; and said new welding electrode is consumed by making a second continuous welding starting at said second depth and drawing said welding electrode back.

6. The method according to claim 5, wherein said second depth corresponds to the end of said first welding, so that a continuous welding is obtained.

7. The method according to claim 1, wherein said welding electrode is a fluxed welding electrode.

8. The method according to claim 1, wherein:

said welding electrode is connected to a semi-rigid conductor before carrying out step b); and during step b), a straightener pushes said welding electrode with the help of said semi-rigid conductor into said axial groove.

9. A method for interlocking and securing two sheet piles comprising the steps of:

a) providing a first sheet pile with a leading sheet pile interlock having therein an interlock chamber;

b) driving said first sheet pile into the ground;

c) providing a second sheet pile with a trailing sheet pile interlock including an interlock head with an axial groove therein;

d) driving said second sheet pile into the ground, wherein said interlock head of said second sheet pile engages said interlock chamber of said first sheet pile, and said axial groove in said interlock head faces a wall of said leading sheet pile interlock in said interlock chamber;

e) axially introducing a welding electrode into said axial groove between said interlock head and said wall of said leading sheet pile interlock; and f) welding said interlock head of said trailing sheet pile interlock to said wall of said leading sheet pile interlock in said interlock chamber.

10. The method according to claim 9, wherein:

said interlock chamber has a substantially right angle corner;

said interlock head has a cross-section that is complementary to the cross-section of said interlock chamber; and said axial groove is arranged in said interlock head so as to face said substantially right angle corner of said interlock chamber.

11. The method according to claim 9, wherein during step b), said interlock chamber is protected against penetration of ground material.

12. The method according to claim 9, wherein said leading sheet pile interlock includes a longitudinal opening giving access to said interlock chamber, and step b) comprises:

inserting an obturating device into said interlock chamber of said leading sheet pile interlock, said obturating device comprising an inflatable tube;

inflating said inflatable tube so that said obturating device closes said longitudinal opening giving access to said interlock chamber;

driving said first sheet pile into the ground, wherein said obturating device prevents ground material from penetrating through said longitudinal opening into said interlock chamber;

deflating said inflatable tube; and withdrawing said obturating device from said interlock chamber.

13. The method according to claim 12, wherein said obturating device comprises an obturating block, and said inflatable tube is inflated so that said obturating block is pushed into said longitudinal opening of said interlock chamber.

14. The method according to claim 13, wherein:

said obturating device further comprises a flexible tube alongside said inflatable tube, and said interlock chamber is filled with sand through said flexible tube while withdrawing said obturating device from said interlock chamber.

15. The method according to claim 9, further comprising:

inserting a front end obturator in the bottom end of said interlock chamber of said leading sheet pile interlock before driving said first sheet pile into the ground.

16. The method according to claim 9, further comprising:

inserting a cleaning piece into said leading sheet pile interlock of said first sheet pile before interlocking it with said trailing sheet pile interlock of said second sheet pile.

* * * * *